US008851834B2

(12) United States Patent
Boehm et al.

(10) Patent No.: US 8,851,834 B2
(45) Date of Patent: Oct. 7, 2014

(54) CENTRIFUGAL PUMP

(71) Applicant: KSB Aktiengesellschaft, Frankenthal (DE)

(72) Inventors: Alexander Boehm, Waischenfeld (DE); Franz Bosbach, Freinsheim (DE); Christoph Keller, Freinsheim (DE); Maike Van Geldern, Uttenreuth (DE); Andreas Weiten, Hettenleidelheim (DE)

(73) Assignee: KSB Aktiengesellscahft, Frankenthal (DE)

( * ) Notice: Subject to any disclaimer, the term of this patent is extended or adjusted under 35 U.S.C. 154(b) by 0 days.

(21) Appl. No.: 13/735,401

(22) Filed: Jan. 7, 2013

(65) Prior Publication Data

US 2013/0121817 A1 May 16, 2013

Related U.S. Application Data

(63) Continuation of application No. PCT/EP2011/059587, filed on Jun. 9, 2011.

(30) Foreign Application Priority Data

Jul. 8, 2010 (DE) ..... 10 2010 026 448

(51) Int. Cl.
*F04D 29/42* (2006.01)
*F04D 1/00* (2006.01)
*F04D 29/02* (2006.01)

(52) U.S. Cl.
CPC ..... *F04D 1/00* (2013.01); *F04D 29/4266* (2013.01); *F04D 29/426* (2013.01); *F04D 29/026* (2013.01); *F04D 29/42* (2013.01); *Y10S 415/915* (2013.01)
USPC ..... 415/206; 415/915

(58) Field of Classification Search
USPC ..... 415/915, 196, 197
See application file for complete search history.

(56) References Cited

U.S. PATENT DOCUMENTS

| | | | | |
|---|---|---|---|---|
| 4,207,025 | A * | 6/1980 | Reynolds et al. | 415/200 |
| 6,508,625 | B1 * | 1/2003 | Hoppenz et al. | 415/200 |
| 8,342,800 | B2 | 1/2013 | Cvjeticanin | |

FOREIGN PATENT DOCUMENTS

| | | | |
|---|---|---|---|
| DE | 2 103 331 | A1 | 8/1972 |
| DE | 4036364 | A1 * | 5/1992 |
| DE | 10 2007 009 781 | A1 | 8/2008 |
| EP | 0 206 031 | A1 | 12/1986 |
| EP | 1 830 071 | A2 | 9/2007 |
| JP | 58117392 | A * | 7/1983 |

OTHER PUBLICATIONS

JP 58-117392 A English Translation. The McElroy Translation Company. Washington D.C. Oct. 2013. 9 Pages.*
International Search Report with English translation dated Sep. 8, 2011 (five (5) pages).
German Written Opinion (Form PCT/ISA/237) (six (6) pages).

* cited by examiner

*Primary Examiner* — Richard Edgar
(74) *Attorney, Agent, or Firm* — Crowell & Moring LLP

(57) ABSTRACT

A centrifugal pump including a rotor and a housing surrounding the rotor, the housing having a connection on the pressure side and another on the intake side, respectively. The housing surrounding the rotor is constructed as a composite part in which a first thin-walled layer (5) defines the inner configuration of the housing, and at least one second layer (11) provides structural stability to the housing.

20 Claims, 4 Drawing Sheets

CENTRIFUGAL PUMP

CROSS REFERENCE TO RELATED APPLICATIONS

This application is a continuation of international patent application no. PCT/EP2011/059587, filed Jun. 9, 2011, designating the United States of America, and published in German on Jan. 12, 2012 as WO 2012/004080 A1, the entire disclosure of which is incorporated herein by reference. Priority is claimed based on Federal Republic of Germany patent application no. DE 10 2010 026 448.2, filed Jul. 8, 2010, the entire disclosure of which is likewise incorporated herein by reference.

BACKGROUND OF THE INVENTION

The invention relates to a centrifugal pump, comprising a rotor and a casing surrounding the rotor and having in each case a delivery-side and a suction-side connection, to a method for producing a centrifugal pump of this type, and to a construction kit for such a centrifugal pump.

Centrifugal pumps are known in many types of construction. The shape of the casing, details of the impeller and sealing have been the subject of comprehensive research and development in recent decades. This has lead to continuous improvement, so that very closely matched centrifugal pumps are available for a large number of different applications. Robust technology is employed in plant construction and mechanical engineering, in water supply and in agricultural irrigation.

Whereas various hydraulically relevant details of the centrifugal pumps described above are designed specifically for the respective application, the basic components, such as, for example, the pump casing, are often of similar design. In the case of relatively large water pumps, a casing made from cast metal, mostly gray cast iron, which is simple to produce and machine, is cost-effective and has a long service life, is typically used. The shafts used are also typically steel shafts which are often produced by generally customary methods. The disadvantage of conventionally produced pumps, however, is that the finished pump is relatively heavy and bulky when it is being transported to the final user.

SUMMARY OF THE INVENTION

The object of the invention is to provide a centrifugal pump comprising a rotor composed of an impeller, a seal and optionally a shaft, and also a casing surrounding the rotor and having in each case a delivery-side and a suction-side connection.

Another object of the invention is to provide a centrifugal pump which overcomes the abovementioned disadvantages.

It is also an object of the invention to provide a method for producing a centrifugal pump of this type.

These and other objects are achieved in accordance with the presently claimed invention by providing a centrifugal pump in which the casing surrounding the rotor is constructed as a composite part, a first thin-walled layer determining the internal shape of the casing, and at least one second layer providing the stability of the casing.

The pump according to the invention affords the possibility of producing at the factory only the first thin-walled layer which determines the internal shape and/or fluid-touched structure of the casing, while the second layer is not applied until the pump is with the final customer. If the material for forming the second layer is available on site at the final customer's premises, there is no need to transport this over long distances, with the result that transport costs can be saved to a considerable extent.

The hydraulically optimized pump casing shape necessary for using the centrifugal pump is determined entirely by the first layer. The application of the second layer can take place on the spot. This second layer serves for the mechanical stabilization of the casing, and it can therefore be applied even by the final customer as long as the required minimum strengths are achieved, this being ensured according to the invention by sufficiently high safety factors.

According to one refinement of the invention, the first layer is formed from a corrosion-resistant metal or a fiber-reinforced plastic. The first layer is in direct contact with the conveyed fluid. By a virtue of such a configuration, the layer is protected from corrosion by the fluid. For example, when drinking water is conveyed, the corrosion protection prevents the water from being contaminated.

Further savings in the transport of the individual parts necessary for the pump are made possible by a refinement according to which the first layer is composed of individual segments constituting the casing shape. This additionally allows exact adaptation to the hydraulic requirements which the centrifugal pump has to fulfill. By various standardized individual parts being combined, different casings can thus be produced simply and cost-effectively.

In a further embodiment, the first layer is formed from an elastomer. This gives rise to a first layer which determines the internal contour of the pump casing which can be packaged in a highly compact way. For use as the first layer of the casing according to the invention the first layer can be filled with a medium, with the result that it acquires its intended shape which is fixed by the second layer.

In a variant of the elastomeric first layer, a space which can be shaped by being filled with a medium is provided within the first layer. This is expedient particularly when the pressure of the medium is higher than the ambient pressure. For this purpose, during production, the elastomeric first layer is executed with regions of different thickness, with the result that deformations which determine the hydraulic properties of the casing can be achieved.

In a further embodiment, a valve is installed in the first layer, holds the pressure of the medium and at the same time indicates, in particular shows, not only the straightforward pressure values, but also the casing configuration or the operating point consequently set. The applied pressure can thus be indicated directly without further aids. Various pump configurations can be set directly via the corresponding internal pressure, since, in particular, the pump space around the impeller can be set differently in terms of its size and shape by application of the media pressure. After the completion of the pump, the indicator can serve for monitoring the operating state of the pump during operation.

An especially simple form of configuration provides a propellant which is delivered along with the required medium under corresponding pressure, so that there is no need on the spot to build up the internal pressure via external compressors or pumps.

In an especially advantageous way, sensor technology for monitoring the operation of the pump is mounted on the outside of the first layer and is concealed directly in the pump casing after the application of the second layer. As a result, for example, wear and corrosion of the inner sheath can be detected.

Furthermore, there is the possibility of connecting the first layer, pressure-tight, to the stationary parts of the rotor and to the connections. The advantage of this is that the leak-tightness of the pump is afforded simply by the connection, provided according to the invention, of the first layer to the pump components. In this embodiment, there is no longer any need for subsequent sealing off.

In a further embodiment, the second layer is composed of a material formed plastically onto the first layer. In order to obtain the best possible bond between the first and the second layer, it is necessary for the material of the second layer to be matched to the surface of the first layer. For this purpose, an appropriate material is one which is cast in a liquid state onto the first layer and is then solidified there.

Plastics, metals, mineral materials or material mixtures are suitable as a plastically formable material. As already illustrated, it is advantageous to select for the second layer a material which can be cast in liquid form onto the first layer. Suitable for this purpose are, for example, cast resins with different fillers, liquid metal, although in this case care must be taken to ensure the heat resistance of the first layer, or concrete. These materials are available throughout the world, the choice being dependent upon the respective requirements to be fulfilled by the pump, such as delivery head and costs.

Advantageously, the plastically formable material is strengthened by reinforcements. This increases the stability of the casing, while at the same time the thickness of the casing can be reduced.

In a further embodiment for improved adhesion of the second layer to the first, conventional surface activations, such as roughening or the application of primer, are provided. The bonding of the materials is thereby improved.

In a further embodiment, the material of the first layer is of the two-ply type. The second layer is then administered between the two plies of the first layer. Consequently, the external shape of the pump can be determined more exactly and the second layer is also protected outwardly against media.

Constituents, which, where appropriate, are obtained from renewable raw materials, are suitable as the material for producing the second layer. Fibers, binders or fillers can be obtained from various plants. These are easily available at many locations, and therefore production is especially beneficial, since local resources can be used both for cultivating and for extracting the materials.

According to a method for producing a centrifugal pump according to the invention, in a first step, all the tolerance ranges are oriented with respect to the shaft. In a second step, the first layer is fixed, pressure-tight, with respect to the tolerance ranges, in a third step, the first layer is filled from inside with a medium and is acted upon with a pressure, and, in a fourth step, the second layer is applied. It is advantageous, here, in contrast to previous manufacturing methods, to reverse the process in which the desired hydraulic structure is conventionally worked into a determined carrying structure or worked out of this. Linings and coatings are known, but not manufacture of the often filigree hydraulic structure with subsequent strengthening.

In a refinement of the method, in the third step, a hydraulically advantageous shape is produced for the first layer by the action of a predetermined pressure. It is advantageous in this case that the internal geometry of the casing can be determined very exactly by the pressure which is administered to the medium in the third step, with the result that flow routing is adapted optimally to the centrifugal pump properties. The pressure is read off directly at the valve in the first layer. Not only the straightforward pressure values, but also the casing configuration or the operating point consequently set can be read off on the scale. The first thin-walled layer is additionally covered with a second layer, with the result that the necessary stiffening of the casing is achieved. When the carrying structure is covered with the second layer, the first layer, as lost formwork, constitutes a component of the composite material. For the use of a centrifugal pump according to the invention, the second layer affords protection against rough ambient conditions and absorbs the acting forces. Depending on the type of construction of the centrifugal pump it is especially advantageous for maintenance purposes to construct the formwork in two parts, so that the casing can be opened for maintenance purposes.

In a further refinement of the method, the second layer, after being applied, is also solidified, in particular by curing, baking or sintering. Depending on the material used, further machining of the casing may also afford additional advantages for the casing. The second layer can be made more stable against mechanical or chemical influences by this step. Moreover, the connection between the first and the second layer can be further improved.

As regards the abovementioned construction of the centrifugal pump, according to the invention a construction kit for producing a centrifugal pump is provided, which comprises various components.

The construction kit according to the invention comprises the rotor and the first layer, the rotor being composed of an impeller and a seal. It is advantageous in this case that a simple and cost-effective basic set for producing an operative centrifugal pump is put together. The missing components are obtained from local suppliers during the construction of the centrifugal pump. The costs for transporting the construction kit can thus be kept low. Local resources in the vicinity of the final consumer can be used. This is advantageous particularly in countries having a comparatively low-level technical infrastructure.

In a further embodiment, the rotor additionally contains a shaft. Since the production of the shaft is subject to demanding dimensional tolerance, it is advantageous to add this to the construction kit. Moreover, the other components of the centrifugal pump may already be premounted onto the shaft.

In addition, there is the possibility of adding a shaft mounting to the construction kit. It is advantageous in this case that the shaft is mounted in a stable way. The stability of the pump is appreciably increased by a shaft mounting. If the shaft mounting is already premounted on the shaft, there is no requirement for any additional outlay for assembly and setting purposes.

Constructing the connections of the centrifugal pump as flanges makes it possible to connect standardized pipes to the centrifugal pump.

In a further embodiment, the outer packaging of the construction kit serves as a casting mold for the second layer. It is advantageous in this case that the outer packaging can be adapted to the requirements to be fulfilled by a casting mold. Both the surface and the stability of the outer packaging can be adapted to the requirements of the casting process by the manufacturer of the construction kit. For example, markings for specific dimensions, such as the position of the shaft or connecting flanges or the maximum filling height for the material of the second layer, can be applied.

Further embodiments may be gathered from the combination of those illustrated hitherto and are therefore not described in any more detail here.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF EMBODIMENTS

Figure 1:
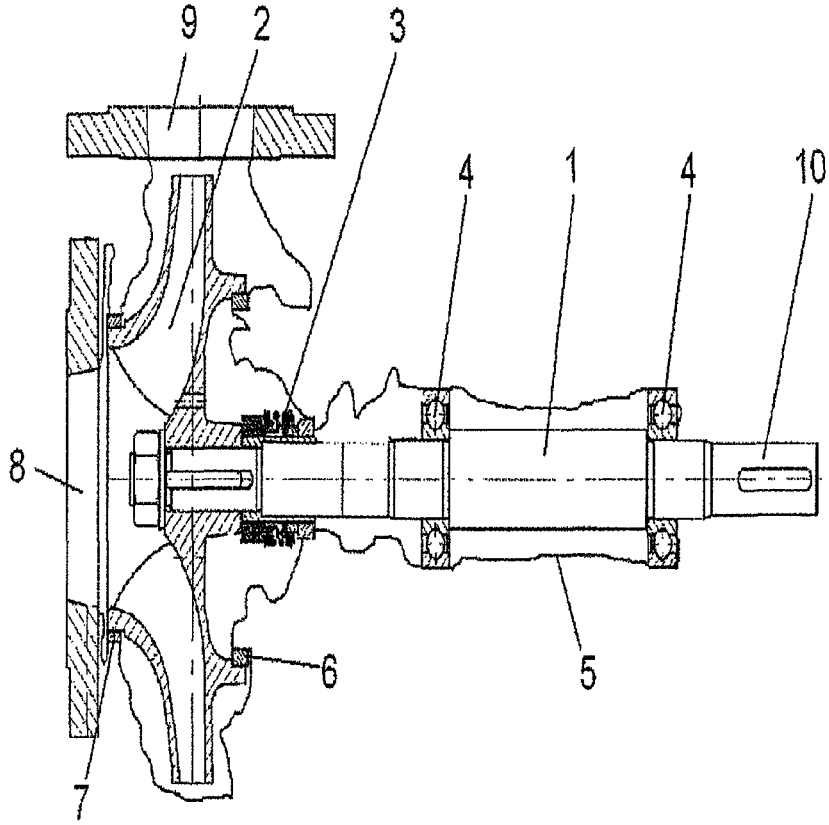
FIG. 1 shows a premounted pump construction kit.

FIG. 1 shows an embodiment of a centrifugal pump according to the invention. An impeller 2 is fastened at the left end of a shaft 1. A seal 3 is arranged so as to be connected directly to the impeller 2. A bellows-type floating ring seal is illustrated in FIG. 1. That part of the seal 3 which is adjacent the impeller 2 is connected firmly to the shaft and co-rotates with the shaft. The stationary part, connected to a casing, of the floating ring seal is arranged at far right. Two bearings 4 are arranged on the shaft 1 at some distance from the seal 2. In a construction kit for this version of the centrifugal pump, all the parts which must satisfy special requirements as to dimensional tolerances are premounted with an exact fit. A first layer 5 sheaths the parts and forms the inner wall of the pump casing. To form the various portions of the pump casing, the first layer 5 is connected directly to some pump parts, while the first layer 5 may also be of multipart construction, in which case the individual parts are each arranged, pressure-tight, between two stationary parts of the rotor. In the region of the impeller 2, the first layer 5 is connected directly to the stationary part of the seal 3. This simple and highly effective connection avoids the need for further sealing means, such as, for example, O-rings. FIG. 1 illustrates the two split rings 6 and 7 which are likewise premounted and connected firmly to the first layer 5. These are likewise connected to the impeller 2 by a simply releasable connection. These connections serve as assembly aids. The split rings remain firmly in place until the completion of the centrifugal pump, so that the required dimensional accuracy is ensured. Before the first use of the centrifugal pump, this connection has to be released so that the impeller is freely rotatable. The connections of the pump to the first layer 5 are likewise provided in the region of the impeller 2. In the example shown, a suction connection piece 8, in extension of the shaft 1, and a delivery connection piece 9 are shown. Both connection pieces are connected firmly to the first layer 5. By the first layer 5 being connected to the bearings 4, two further spaces arise between the seal 3 and the first bearing 4 and between the two bearings 4. At the right end, a shaft end 10 remains outside the first layer, the pump drive being connected to said shaft end. FIG. 1 shows that the first layer 5 is composed of a deformable material which can be applied closely onto the shaft 1. The semifinished centrifugal pump can consequently be packaged so as to be very small for shipping purposes.

Figure 2:
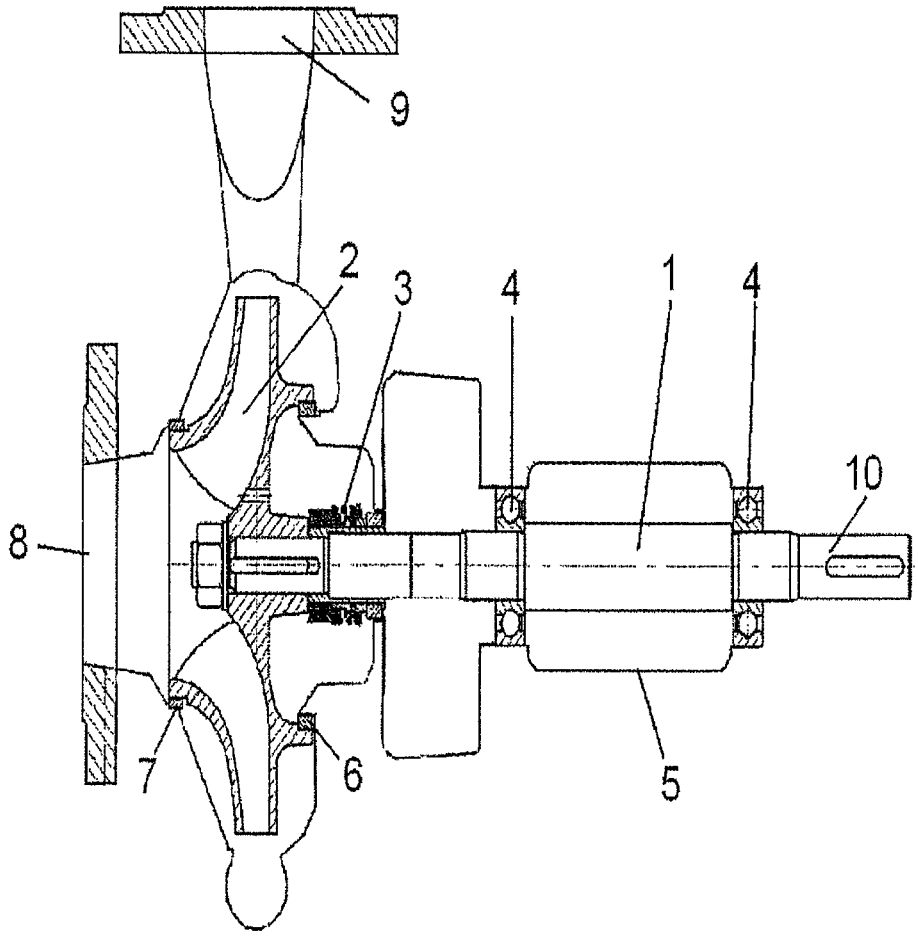
FIG. 2 shows the construction kit during machining.

FIG. 2 shows a semifinished centrifugal pump according to the third step of the method for producing a centrifugal pump according to the invention. The first layer is filled from inside with a medium and is acted upon by a pressure. The connections for the pressure compensation between the individual regions and also the fastenings of the delivery and suction connection pieces are not shown in FIG. 2. The internal shape of the casing is thus clearly defined. Depending on the choice of material for the first layer 5, it is possible to influence the hydraulic properties of the pump space by the pressure applied to the medium. Various geometries of the casing can thus be produced in the region around the impeller.

Figure 3:
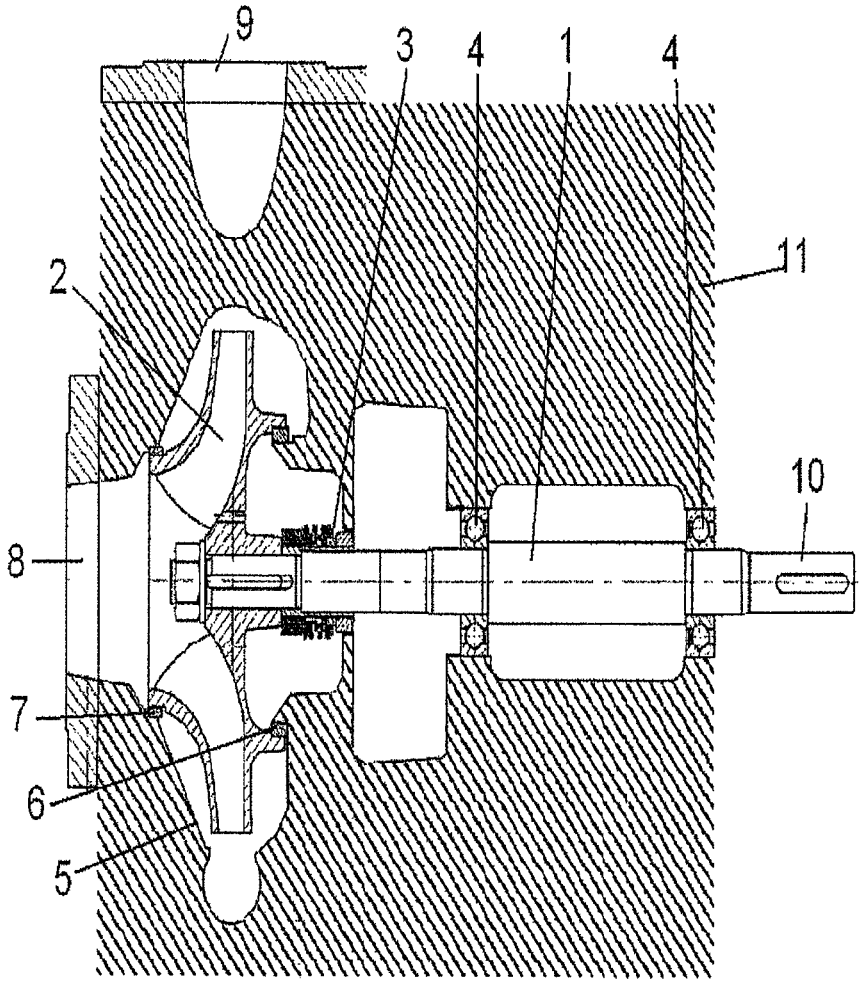
FIG. 3 shows a first version of a finished pump.

FIG. 3 shows a first version of a finished pump. In this case, the semifinished component illustrated in FIG. 2 has had a second layer 11 cast around it completely in the shipping container (not shown). This form of the second layer 11 is the simplest to produce, since the external appearance of the pump does not have to satisfy any requirements, except for a material-dependent minimum wall thickness. For example, concrete may be used as material for the second layer. Materials, such as clay, which is mixed with fibers, synthetic resin or comparable castable materials which solidify, are also suitable for this form of strengthening. This figure does not illustrate additional reinforcing elements on the stationary parts 3, 4, 6, 7, 8, 9. These are connected firmly to the stationary parts and project into the region of the second layer 11, with the result that the positioning and fixing of the stationary parts in the finished centrifugal pump are improved.

Figure 4:
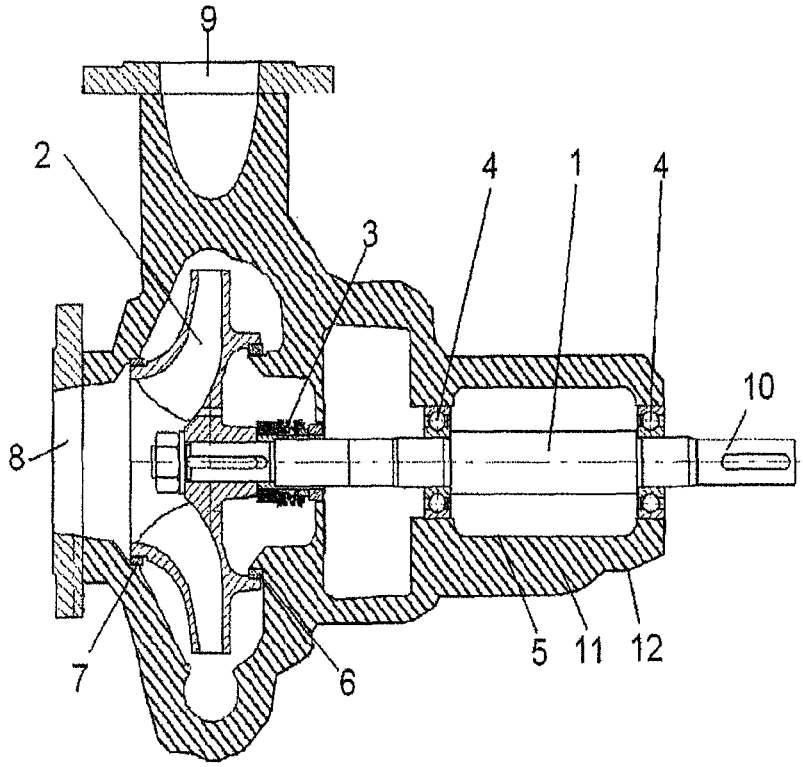
FIG. 4 shows a second version of a finished pump.

FIG. 4 shows a second version of a finished pump. In order likewise to determine the external shape of the pump casing, in this version an additional jacket layer 12 has been provided, which is likewise composed of flexible material so that the advantage of compact packaging during transport is maintained. To strengthen the pump casing, in this version the second layer 11 has been introduced between the first layer 5 and the jacket layer 12. This variant of the centrifugal pump according to the invention makes it possible to utilize forms of construction which take into account restricted space conditions at the place of use and which are more efficient in terms of use of resources.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A centrifugal pump comprising a rotor and a casing surrounding said rotor, said casing having respective delivery-side and suction-side connections, wherein the casing surrounding the rotor is constructed as a composite part with a first layer which determines the internal shape of the casing and at least one second layer which provides structural stability to the casing, wherein the first layer is connected in a pressure-tight manner to components arranged on a shaft and to the delivery-side and suction-side connections and the second layer is composed of a material formed plastically onto the first layer.

2. The centrifugal pump as claimed in claim 1, wherein the first layer is formed from a corrosion-resistant metal or a fiber-reinforced plastic.

3. The centrifugal pump as claimed in claim 1, wherein the first layer is composed of a plurality of individual segments which together constitute the casing shape.

4. The centrifugal pump as claimed in claim 1, wherein the first layer is formed from an elastomer.

5. The centrifugal pump as claimed in claim 1, wherein the space within the first layer can be shaped by being filled with a medium under pressure.

6. The centrifugal pump as claimed in claim 5, wherein further comprising a valve installed in the first layer, and wherein said valve holds and indicates the pressure of the medium.

7. The centrifugal pump as claimed in claim 5, wherein said pump comprises an indicator which indicates both the pressure of the medium and the configuration or consequent operating point of the casing.

8. The centrifugal pump as claimed in claim 5, wherein a propellant is provided which provides the medium under pressure required for filling the first layer.

9. The centrifugal pump as claimed in claim 1, wherein the plastically formable material is a plastic, a metal, a mineral material or a material mixture.

10. The centrifugal pump as claimed in claim 1, wherein the plastically formable material is strengthened by reinforcements.

11. The centrifugal pump as claimed in claim 1, wherein surface of the first layer is activated to provide improved adhesion between the second layer and the first layer.

12. The centrifugal pump as claimed in claim 1, wherein the material of the first layer is a two-ply material.

13. A construction kit for a centrifugal pump as claimed in claim 1, wherein said construction kit contains the rotor of the centrifugal pump and the first layer, and wherein the rotor comprises an impeller and a seal.

14. The construction kit as claimed in claim 13, wherein the rotor additionally comprises a shaft.

15. The construction kit as claimed in claim 13, wherein the rotor comprises a shaft mounting.

16. The construction kit as claimed in claim 13, wherein the connections are constructed as flanges.

17. The construction kit as claimed in claim 13, wherein an outer packaging of the construction kit serves as a casting mold for the second layer.

18. A method for producing a centrifugal pump as claimed in claim 1, said method comprising:

adjusting all tolerance ranges of the respective parts relative to a shaft;

affixing the first layer to the shaft in a pressure-tight manner;

filling the first layer from inside with a medium under pressure; and applying the second layer over the pressurized first layer.

19. The method as claimed in claim 18, wherein a hydraulically advantageous shape is produced for the first layer by application of a predetermined pressure by the medium under pressure.

20. The method as claimed in claim 18, wherein after application of the second layer, said second layer is solidified by curing, baking or sintering.

* * * * *